US009222236B2

(12) United States Patent
Ishibashi et al.

(10) Patent No.: US 9,222,236 B2
(45) Date of Patent: Dec. 29, 2015

(54) BULLDOZER AND BLADE CONTROL METHOD

(71) Applicant: KOMATSU LTD., Tokyo (JP)

(72) Inventors: Eiji Ishibashi, Komatsu (JP); Hidehiro Hashimoto, Komatsu (JP); Kenji Yamamoto, Kaga (JP); Yasuhito Yonezawa, Komatsu (JP); Fumio Imamura, Hakusan (JP); Kenjiro Shimada, Komatsu (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 14/114,845

(22) PCT Filed: May 28, 2013

(86) PCT No.: PCT/JP2013/064713
§ 371 (c)(1),
(2) Date: Oct. 30, 2013

(87) PCT Pub. No.: WO2014/136278
PCT Pub. Date: Sep. 12, 2014

(65) Prior Publication Data

US 2014/0257646 A1 Sep. 11, 2014

(30) Foreign Application Priority Data

Mar. 8, 2013 (JP) ..... 2013-046671

(51) Int. Cl.
*E02F 3/84* (2006.01)
*E02F 3/76* (2006.01)
*E02F 9/20* (2006.01)

(52) U.S. Cl.
CPC ..... *E02F 3/844* (2013.01); *E02F 3/7613* (2013.01); *E02F 3/7618* (2013.01); *E02F 9/2041* (2013.01)

(58) Field of Classification Search
None
See application file for complete search history.

(56) References Cited

U.S. PATENT DOCUMENTS 4,630,685 A 12/1986 Huck, Jr. et al.
4,934,463 A * 6/1990 Ishida ..... E02F 3/844 172/4.5

(Continued)

FOREIGN PATENT DOCUMENTS

JP 61-500449 A 3/1986
JP 3516279 B2 1/2004

OTHER PUBLICATIONS

International Search Report for PCT/JP2013/064713, issued on Aug. 27, 2013.

*Primary Examiner* — Rami Khatib
*Assistant Examiner* — David Merlino
(74) *Attorney, Agent, or Firm* — Global IP Counselors, LLP

(57) ABSTRACT

A bulldozer includes a blade pivotably attached to a vehicle body, a blade operation lever, and a blade control section. The blade operation lever outputs a lowering instruction signal, a holding instruction signal, and a raising instruction signal for the blade. The blade control section controls a height of the blade according the signal input. The blade control section can lower the blade to a predetermined position when the lowering instruction signal and the holding instruction signal are input in order after a transmission has been switched from a state, which is different from an advancing state, to the advancing state. The blade control section can raise the blade to a predetermined position when the raising instruction signal and the holding instruction signal are input in order after a transmission has been switched from a state, which is different from a reversing state, to the reversing state.

6 Claims, 8 Drawing Sheets

(56) References Cited

U.S. PATENT DOCUMENTS 5,398,766 A * 3/1995 Nakayama et al. ..... 172/4.5
5,538,084 A * 7/1996 Nakayama ..... E02F 3/844 172/2
5,555,942 A * 9/1996 Matsushita ..... E02F 3/844 701/50
5,819,190 A * 10/1998 Nakagami ..... E02F 3/844 701/50
5,862,868 A * 1/1999 Yamamoto ..... E02F 3/844 701/50
6,718,246 B2 * 4/2004 Griffith et al. ..... 701/50
7,121,355 B2 * 10/2006 Lumpkins et al. ..... 172/4.5
7,686,095 B2 * 3/2010 Batthala et al. ..... 701/50
8,019,515 B2 * 9/2011 Okeson ..... E02F 3/7609 701/50
8,616,297 B2 * 12/2013 Shintani ..... E02F 3/7609 172/407
2005/0205272 A1 * 9/2005 Suzuki ..... E02F 3/844 172/812
2009/0007772 A1 * 1/2009 Yamamoto ..... E02F 3/844 91/436
2013/0317707 A1 * 11/2013 Farmer ..... E02F 3/845 701/50

* cited by examiner

BULLDOZER AND BLADE CONTROL METHOD

CROSS-REFERENCE TO RELATED APPLICATIONS

This application is a U.S. National stage application of International Application No. PCT/JP2013/064713, filed on May 28, 2013. This U.S. National stage application claims priority under 35 U.S.C. §119(a) to Japanese Patent Application No. 2013-046671, filed in Japan on Mar. 8, 2013, the entire contents of which are hereby incorporated herein by reference.

BACKGROUND

1. Field of the Invention

The present invention relates to a bulldozer which is provided with a blade which is a work machine and a blade control method for the bulldozer.

2. Background Information

A bulldozer which is one example of a work vehicle is a tractor which has a crawler movement apparatus and is provided with an earth moving plate (blade) as a work machine at the front of the vehicle. The blade is used for work such as bulldozing work where surface earth or the like is pushed and carried and ground leveling work where the ground surface is flattened.

In the past, a method has been proposed for automatically lowering the blade to where the lower edge of the blade comes into contact with the ground surface according to switching of transmission during bulldozing work in automatic driving to an advancing state (refer to U.S. Pat. No. 5,555,942). According to this method, it is possible to assist an operator such that it is possible to easily start bulldozing work where it is necessary to repeat forward and backward movement.

Here, a digging mode and ground leveling mode are generally included in the bulldozing work in automatic driving. The digging mode is a mode in which the height of the blade is automatically adjusted with regard to the designed surface such that a load which is applied on the blade enters a predetermined range while the blade is observed so as not to be lowered below the designed surface. The ground leveling mode is a mode in which the height of the blade is automatically adjusted with regard to the designed surface such that a cutting edge of the blade is moved along the designed surface.

SUMMARY

However, according to the method of U.S. Pat. No. 5,555,942, the blade is automatically lowered regardless of the intention of the operator when switching the transmission to an advancing state. As a result, it is necessary to switch the transmission after the automatic driving is stopped to the advancing state in a case where it is desired that the blade be lowered once the bulldozer has advanced to the desired location.

In this manner, the method in U.S. Pat. No. 5,555,942 there is a problem in that it is not possible to competently reflect the intention of the operator during blade control.

The object of the present invention is to provide a bulldozer and a blade control method where it is possible to execute blade control according to an intention of an operator in view of the circumstances described above.

A bulldozer according to a first aspect is provided with a blade, a blade operation lever, and a blade control section. The blade is a work machine. The blade is pivotably attached to a vehicle body. The blade operation lever is configured to output a lowering instruction signal, a holding instruction signal, and a raising instruction signal for the blade. The blade control section is configured to control a height of the blade according to the lowering instruction signal or the raising instruction signal when the lowering instruction signal or the raising instruction signal is input. The blade control section is configured to lower the blade to a predetermined position when the lowering instruction signal and the holding instruction signal are input in order after a transmission has been switched from a state which is different to an advancing state to the advancing state.

In the bulldozer according to the first aspect, it is possible to reduce a load due to a blade operation by an operator in repeated forward and backward movement work. At the same time, it is possible to suppress execution of the automatic lowering operation of the blade which is against the intention of the operator since an automatic lowering operation of the blade is executed with a lowering instruction signal for the blade from the operator as a trigger. Accordingly, it is possible to execute control of the blade according to the intention of the operator.

The bulldozer according to a second aspect is the bulldozer according to the first aspect where the blade control section is configured to lower the blade to the predetermined position at a lowering speed based on an operating amount of the blade operation lever. The operating amount corresponds to the lowering instruction signal which is input.

In the bulldozer according to the second aspect, it is possible to execute control of the blade further according to the intention of the operator since the automatic lowering operation of the blade is executed at a lowering speed which is desired by the operator.

The bulldozer according to a third aspect is the bulldozer according to the second aspect where the blade control section is configured to use the operating amount which is held for a predetermined time immediately before the holding instruction signal is input as the operating amount of the blade operation lever.

In the bulldozer according to the third aspect, it is possible for the automatic lowering operation to reflect the intention of the operator since the blade is controlled based on the operating amount which is input last by the operator.

The bulldozer according to a fourth aspect is the bulldozer according to the second aspect where, when the operating amount of the blade operation lever is held at a first value for a first time period and is returned to zero after being held at a second value which is smaller than the first value for a second time period, the blade control section is configured to determine the lowering speed based on the second value.

In the bulldozer according to the fourth aspect, it is possible for the automatic lowering operation to reflect precise operation of the blade operation lever by the operator.

The bulldozer according to a fifth aspect is provided with a blade, a blade operation lever, and a blade control section. The blade is a work machine. The blade is pivotably attached to a vehicle body. The blade operation lever is configured to output a lowering instruction signal, a holding instruction signal, and a raising instruction signal for the blade. The blade control section is configured to control a height of the blade according to a signal which has been input when the signal of either the lowering instruction signal or the raising instruction signal is input. The blade control section is configured to raise the blade to a predetermined position when the raising instruction signal and the holding instruction signal are input in order after a transmission has been switched from a state which is different to a reversing state to the reversing state.

In the bulldozer according to the fifth aspect, it is possible to reduce the load due to the blade operation by the operator in repeated forward and backward movement work. At the same time, it is possible to suppress execution of an automatic raising operation of the blade which is against the intention of the operator since the automatic raising operation of the blade is executed with the raising instruction signal for the blade from the operator as the trigger. Accordingly, it is possible to execute control of the blade according to the intention of the operator.

A blade control method of the bulldozer according to a sixth aspect is a blade control method in a bulldozer having a blade which is a work machine pivotably attached to a vehicle body. This blade control method includes switching a transmission from a state which is different to an advancing state to the advancing state, outputting a lowering instruction signal and a holding instruction signal for the blade in order, and lowering the blade to a predetermined position above a designed surface which is three dimensional designated terrain which indicates the desired shape of a digging target.

In the blade control method of the bulldozer according to the sixth aspect, it is possible to reduce the load due the blade operation by the operator while executing control of the blade according to the intention of the operator in repeated forward and backward movement work.

According to the present invention, it is possible to provide a control apparatus, an operating machine, and a blade control method where a simplified blade operation is possible while reflecting an intention of an operator.

DESCRIPTION OF EMBODIMENTS

Below, the configuration of a bulldozer 100 according to the present embodiment will be described with reference to the drawings. In the description below, "up", "down", "front", "back", "left" and "right" are terms with an operator who is seated in a driver's seat as a reference.

External Configuration of Bulldozer 100

Figure 1:
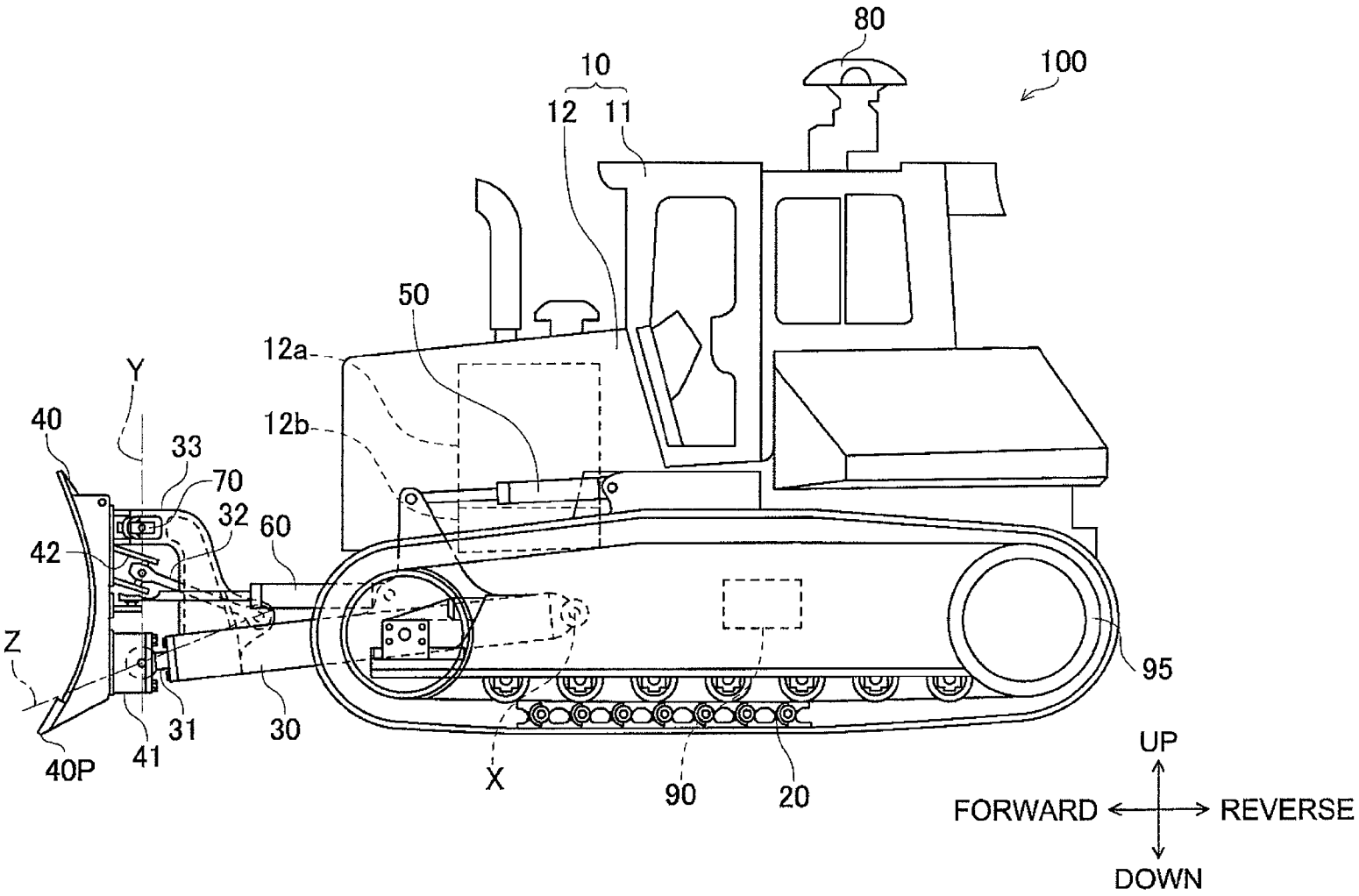
FIG. 1 is a side surface diagram illustrating an entire configuration of a bulldozer.

FIG. 1 is a side surface diagram illustrating an external configuration of the bulldozer 100.

The bulldozer 100 is provided with a vehicle body 10, a movement apparatus 20, a lift frame 30, a blade 40, a lift cylinder 50, an angle cylinder 60, a tilt cylinder 70, a GPS receiver 80, an IMU (Inertial Measurement Unit) 90, and a pair of sprockets 95.

The vehicle body 10 has a cab 11 and a machine compartment 12. An automatic driving switch 260, a blade operation lever 270, and a shift lever 280 (refer to FIG. 3 for each) which will be described later and a driver's seat (which is not shown in the diagram) are arranged in the cab 11. The machine compartment 12 accommodates an engine 12*a* and a hydraulic static transmission 12*b*. In addition, a blade controller 210, a proportional control valve 220, a hydraulic pump 230, a hydraulic sensor 240, and a designed surface data storage section 250 (refer to FIG. 3) which will be described later are arranged in the machine compartment 12.

The movement apparatus 20 is configured by a pair of crawler tracks (only the left side crawler track is shown in FIG. 1), the sprockets 95, and an idler. The movement apparatus 20 is attached to a lower part of the vehicle body 10. The bulldozer 100 moves due to the pair of crawler tracks being rotated according to driving of the pair of sprockets 95.

The lift frame 30 is arranged at an inner side of the movement apparatus 20 in a vehicle width direction (that is, a left and right direction). The lift frame 30 is attached to the vehicle body 10 so as to be able to swing up and down with an axis X which is parallel to the vehicle width direction as the center. The lift frame 30 supports the blade 40 via a ball joint part 31, a pitch support link 32, and a support column part 33.

The blade 40 is arranged in front of the vehicle body 10. The blade 40 has a universal joint 41 which is linked to the ball-joint part 31 and a pitching joint 42 which is linked to the pitch support link 32. The blade 40 moves up and down to accompany the up and down swinging of the lift frame 30. A cutting edge 40P which is inserted into a ground surface GL in leveling work or digging work is formed at a lower edge part of the blade 40.

The lift cylinder 50 links the vehicle body 10 and the lift frame 30. The blade 40 swings up and down with the X axis as the center due to the expansion and contraction of the lift cylinder 50.

Figure 2:
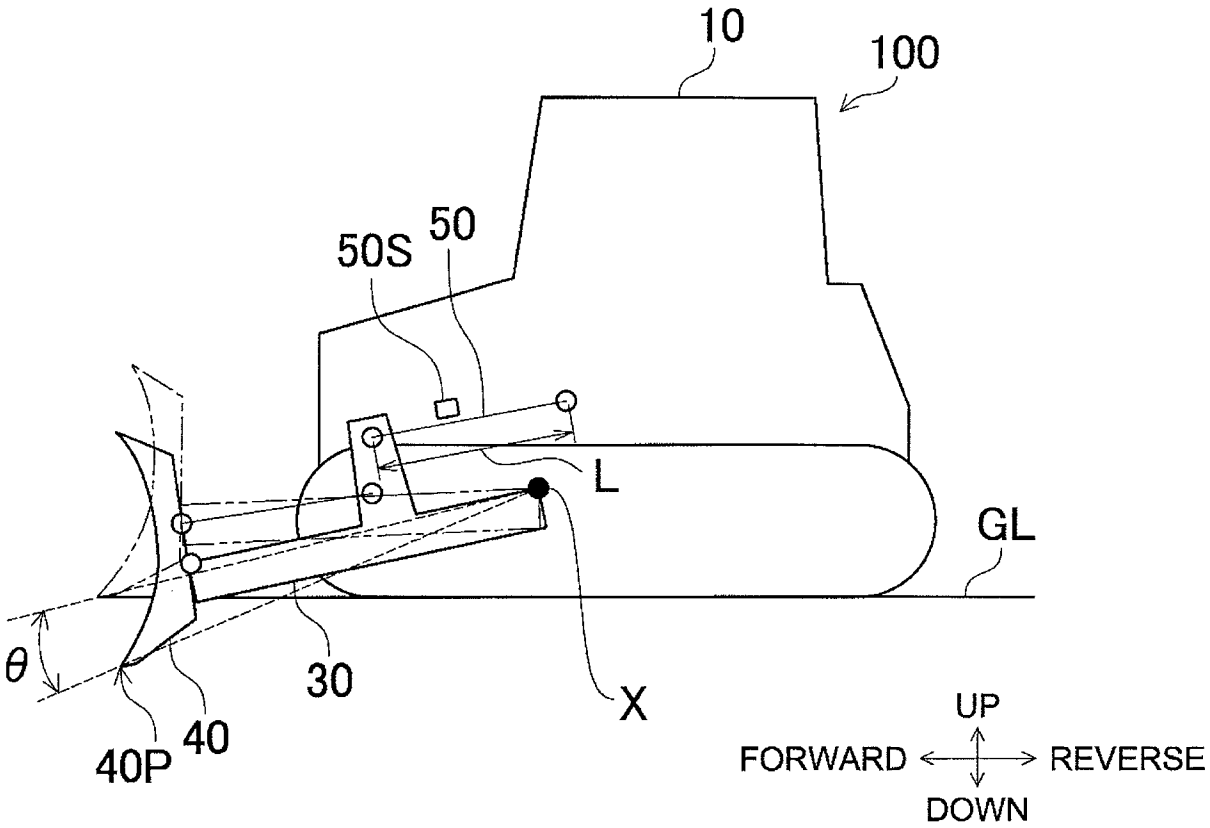
FIG. 2 is a schematic diagram illustrating a configuration of the bulldozer.

Here, FIG. 2 is a schematic diagram illustrating a configuration of the bulldozer 100. In FIG. 2, the original position of the blade 40 is shown by a two-dot chain line. The cutting edge 40P of the blade 40 comes into contact with the ground surface GL in a case where the blade 40 is positioned in the original position. As shown in FIG. 2, the bulldozer 100 is provided with a lift cylinder sensor 50S. The lift cylinder sensor 50S is configured by a rotary roller for detecting the position of a rod and a magnetic sensor for returning the position of the rod to the original position. The lift cylinder sensor 50S detects the stroke length (referred to below as a "lift cylinder length L") of the lift cylinder 50. As will be described later, the blade controller 210 (refer to FIG. 3) calculates a lift angle θ of the blade 40 based on the lift cylinder length L. The lift angle θ corresponds to a lowering angle from the original position of the blade 40, that is, the penetration depth of the cutting edge 40P into the ground. Bulldozing work is performed by the bulldozer 100 by the blade 40 advancing in a state of being lowered from the original position.

The angle cylinder 60 links the lift frame 30 and the blade 40. The blade 40 swings with an axis Y, which passes through a rotation center of each of the universal joint 41 and the pitching joint 42, as the center due to the expansion and contraction of the angle cylinder 60.

The tilt cylinder 70 links the support column part 33 of the lift frame 30 and the right upper edge part of the blade 40. The blade 40 swings with an axis Z, which links the ball-joint part 31 and a lower edge part of the pitch support link 32, as the center due to the expansion and contraction of the tilt cylinder 70.

The GPS receiver 80 is arranged above the cab 11. The GPS receiver 80 is a GPS (Global Positioning System) antenna.

The GPS receiver 80 sends and receives GPS data using calculations of the position of the device itself.

The IMU 90 is an inertial measurement device and acquires vehicle body inclination angle data which expresses a vehicle body inclination angle at the front, back, left, and right with regard to the horizontal direction. The IMU 90 sends vehicle body inclination data to the blade controller 210.

The pair of sprockets 95 is driven by the engine 12*a* which is accommodated in the machine compartment 12. The movement apparatus 20 is driven in an advancing direction by the pair of sprockets 95 in a case where the transmission 12*b* is in the advancing state, and the movement apparatus 20 is driven in a reversing direction by the pair of sprockets 95 in a case where the transmission 12*b* is in the reversing state. The movement apparatus 20 is not driven in a case where the transmission 12*b* is in a neutral state.

Inner Configuration of Bulldozer 100

Figure 3:
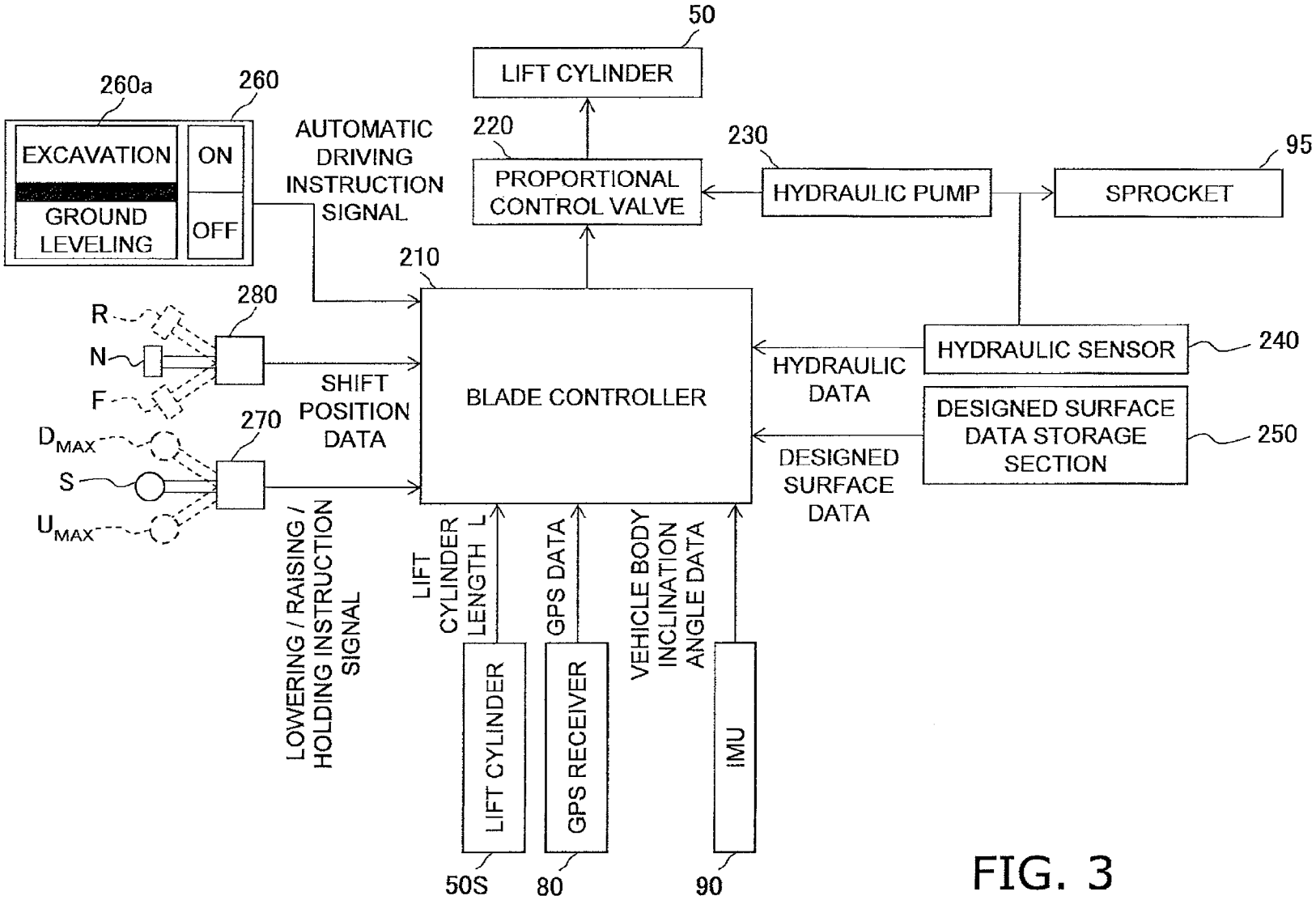
FIG. 3 is a block diagram illustrating an inner configuration of the bulldozer.

FIG. 3 is a block diagram illustrating the inner configuration of the bulldozer. The bulldozer 100 is provided with the blade controller 210, the proportional control valve 220, the hydraulic pump 230, the hydraulic sensor 240, the designed surface data storage section 250, the automatic driving switch 260, the blade operation lever 270, and the shift lever 280.

The blade controller 210 executes bulldozing work while automatically adjusting the height of the blade 40 with regard to the designed surface based on the lift cylinder length L, GPS data, vehicle body inclination angle data, designed surface data, and pressure data in a case where an automatic driving start instruction signal for the bulldozing work is acquired from the automatic driving switch 260. There are the digging mode and the ground leveling mode in the automatic driving of such bulldozing work. The height of the blade 40 is automatically adjusted with regard to the designed surface such that the load (below, referred to as the "blade load") which is applied to the blade 40 is in the desired range while the cutting edge 40P is monitored so as not to be lowered below than the designed surface in the digging mode. The height of the blade 40 is automatically adjusted with regard to the designed surface such that the cutting edge 40P of the blade 40 is moved along the designed surface in the ground leveling mode.

The blade controller 210 adjusts the height of the blade 40 according to the operation by the operator in a case where the operator operates the blade operation lever 270 even during automatic driving in bulldozing work.

The blade controller 210 automatically lowers the blade 40 to the predetermined position when the operator confirms the lowering of the blade 40 in a manual operation in a case where the transmission 12*b* is switched to the advancing state during automatic driving in bulldozing work. The automatic lowering of the blade 40 will be described later.

The blade controller 210 outputs a control signal (an electric current) to the proportional control valve 220 in a case where the blade 40 is raised or lowered.

The proportional control valve 220 is arranged between the lift cylinder 50 and the hydraulic pump 230. The extent of the opening of the proportional control valve 220 is adjusted according to the control signal (the electric current) from the blade controller 210.

The hydraulic pump 230 is coupled to the engine 12*a* and supplies hydraulic oil for driving the pair of sprockets 95. In addition, the hydraulic pump 230 supplies hydraulic oil to the lift cylinder 50 via the proportional control valve 220.

The hydraulic sensor 240 detects pressure of the hydraulic oil which is supplied from the hydraulic pump 230 to the pair of sprockets 95. Pressure which is detected by the hydraulic sensor 240 corresponds to traction force of the movement apparatus 20. Therefore, it is possible for the blade load to be measured based on the pressure which is detected by the hydraulic sensor 240.

The designed surface data storage section 250 stores designed surface data which expresses the position and shape of the designed surface which has a three dimensional designated shape which indicates the desired shape of the digging target in a work area.

The automatic driving switch 260 outputs a start/stop instruction signal for automatic driving to the blade controller 210 according to the operation by the operator.

A switching switch 260*a* for switching between the digging mode and the ground leveling mode is provided in the automatic driving switch 260. The automatic driving switch 260 outputs the start/stop instruction signal for automatic driving, which indicates the digging mode or the ground leveling mode, to the blade controller 210.

The blade operation lever 270 is an operating tool for the operator to manually drive the blade 40. The blade operation lever 270 is able to be tilted from a holding position S to a maximum lowering position $D_{MAX}$, and is able to be tilted from the holding position S to a maximum raising position $U_{MAX}$.

The blade operation lever 270 outputs the holding instruction signal to the blade controller 210 in a case of being stationary in the holding position S. The blade operation lever 270 outputs the lowering instruction signal for the blade 40 to the blade controller 210 in a case of being tilted from the holding position S to the maximum lowering position $D_{MAX}$ side. The blade operation lever 270 outputs the raising instruction signal for the blade 40 to the blade controller 210 in a case of being tilted from the holding position S to the maximum raising position $U_{MAX}$ side. Information which indicates an operating amount V of the blade operation lever 270 is included in the lowering instruction signal and the raising instruction signal. In the present embodiment, the operating amount V which is output as the lowering instruction signal is a positive value, the operating amount V which is output as the holding instruction signal is zero ("0"), and the operating amount V which is output as the raising instruction signal is a negative value. The operating amount V corresponds to the lowering speed and the raising speed of the blade 40, and as the absolute value of the operating amount V increases, the lowering speed and the raising speed of the blade 40 increases. It is possible, for example, for the operating amount V of the blade operation lever 270 to be expresses as a tilt angle from the holding position S.

The shift lever 280 is an operating tool for the operator to set the transmission 12*b* in any one of the advancing state, the reversing state, or the neutral state. It is possible for the shift lever 280 to be moved from a neutral position N to an advancing position F or a reversing position R. The shift lever 280 outputs shift position data which indicates the position of any one of the neutral position N, the advancing position F, and the reversing position R to the blade controller 210

Functions of Blade Controller 210

Figure 4:
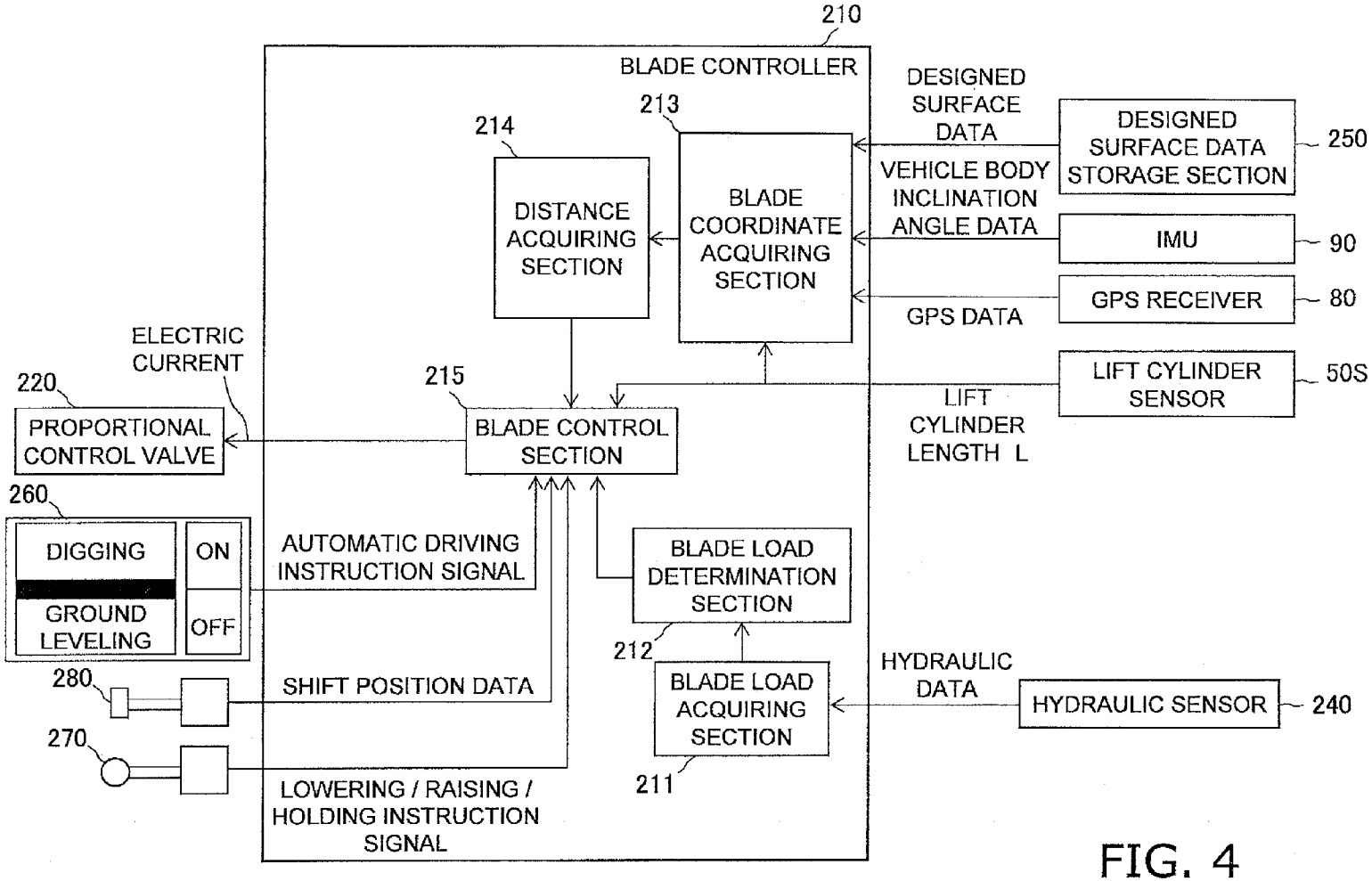
FIG. 4 is a block diagram illustrating functions of a blade controller.
Figure 5:
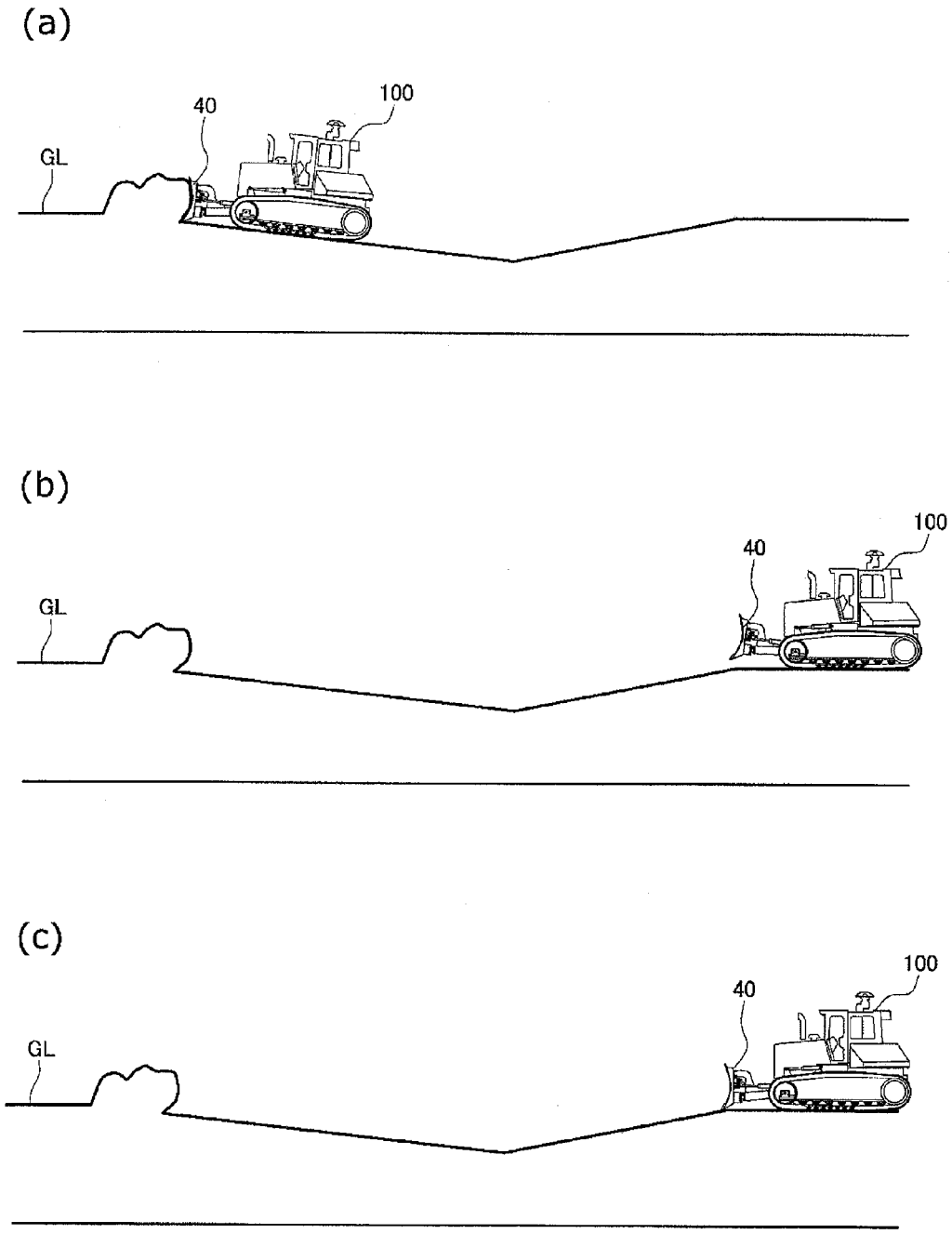
FIGS. 5(*a*) to 5(*c*) are diagrams for describing bulldozing work during automatic driving.

FIG. 4 is a block diagram illustrating functions of the blade controller 210. FIGS. 5(*a*) to 5(*c*) are schematic diagrams for describing bulldozing work during automatic driving.

As shown in FIG. 4, the blade controller 210 has a blade load acquiring section 211, a blade load determination section 212, a blade coordinate acquiring section 213, a distance acquiring section 214, and a blade control section 215.

The blade load acquiring section 211 acquires data on the pressure of the hydraulic oil, which is supplied to the pair of sprockets 95, from the hydraulic sensor 240. The blade load acquiring section 211 calculates the blade load which is applied to the blade 40 based on the pressure data.

The blade load determination section 212 determines whether or not the blade load which is acquired by the blade load acquiring section 211 is within a predetermined range. The blade load determination section 212 provides notification of the determination result to the blade control section 215.

The blade coordinate acquiring section 213 acquires the lift cylinder length L, GPS data, and vehicle body inclination angle data. The blade coordinate acquiring section 213 calculates global coordinates of the GPS receiver 80 based on the GPS data. The blade coordinate acquiring section 213 computes the lift angle θ (refer to FIG. 2) based on the lift cylinder length L. The blade coordinate acquiring section 213 calculates the local coordinates of the blade 40 (in detail, the blade cutting edge 40P) with regard to the GPS receiver 80 based on the lift angle θ and vehicle body dimensions data. The blade coordinate acquiring section 213 calculates the global coordinates of the blade 40 based on the global coordinates of the GPS receiver 80, the local coordinates of the blade 40, and the vehicle body inclination angle data.

The distance acquiring section 214 acquires the global coordinates of the blade 40 and the designed surface data. The distance acquiring section 214 calculates the distance between the designed surface and the blade 40 in a direction which is perpendicular to the designed surface based on the global coordinates of the blade 40 and the designed surface data.

The blade control section 215 starts the automatic driving of the bulldozing work in the digging mode or the ground leveling mode when an automatic driving start instruction is acquired from the automatic driving switch 260. The blade control section 215 stops the automatic driving of the bulldozing work when an automatic driving stop instruction is acquired from the automatic driving switch 260.

The blade control section 215 automatically adjusts the height of the blade 40 with regard to the designed surface such that the blade load is in the desired range by referencing the determination result of the blade load determination section 212 in a case where the bulldozing work is automatically driven in the digging mode. In this case, the blade control section 215 monitors such that the blade 40 is not lowered below the designed surface by referencing the distance of the blade 40 with regard to the designed surface which is computed by the distance acquiring section 214. On the other hand, the blade control section 215 holds the blade 40 at a position with a predetermined gap (≥0) from the designed surface by referencing the distance of the blade 40 with regard to the designed surface which is computed by the distance acquiring section 214 in a case where the bulldozing work is automatically driven in the ground leveling mode.

In typical bulldozing work, work is performed using the digging mode in an initial step, and work is performed using the ground leveling mode in a subsequent step. During this bulldozing work, the bulldozer moves repeatedly between a first point and a second point.

In detail, the shift lever 280 outputs shift position data which indicates the reversing position R to the blade control section 215 when the operator sets the shift lever 280 to the reversing position R after the bulldozing work has been performed from the first point to the second point. As shown in FIG. 5(*a*), the blade control section 215 raises the blade 40 to a position which is higher than the original position when the shift position data which indicates the reversing position R is acquired.

After that, the shift lever 280 outputs shift position data which indicates the advancing position F to the blade control section 215 when the operator sets the shift lever 280 to the advancing position F after the bulldozer 100 has reversed from the second point to the first point. Even at this point in time, the blade control section 215 holds the blade 40 at the position which is higher than the original position as shown in FIG. 5(*b*).

Next, the blade operation lever 270 outputs a lowering instruction signal for the blade 40 to the blade control section 215 when the operator tilts the blade operation lever 270 from the holding position S to the maximum lowering position $D_{MAX}$. The blade control section 215 outputs an electric current to the proportional control valve 220 according to the operating amount V of the blade operation lever 270 which is included in the lowering instruction signal. According to this, the blade 40 is lowered at a speed according to the operating amount V of the blade operation lever 270. Due to this, the lowering work of the blade 40 is started due to a manual operation by the operator.

Next, the blade operation lever 270 outputs a holding instruction signal for the blade 40 to the blade control section 215 when the operator returns the blade operation lever 270 to the holding position S. At this time, the blade control section 215 determines whether or not the blade 40 is positioned below the original position, that is, whether or not the blade 40 has reached the ground surface GL, based on the lift cylinder height L.

The blade control section 215 stops the blade 40 by stopping the output of the electric current to the proportional control valve 220 in a case where the blade 40 has reached the ground surface GL. On the other hand, the blade control section 215 determines the lowering speed of the blade 40 based on the operating amount V of the blade operation lever 270 which is included in the prior lowering instruction signal in a case where the blade 40 has not reached the ground surface GL. The blade control section 215 outputs an electric current to the proportional control valve 220, according to the lowering speed which has been determined, until the blade 40 reaches the original position.

As shown in FIG. 5(*c*), the blade control section 215 stops the output of the electric current to the proportional control valve 220 when the blade 40 reaches the original position. Due to this, the automatic lowering operation (alignment of the cutting edge) of the blade 40 which is triggered by the lowering operation of the operator is executed and the preparation of the subsequent bulldozing work is completed.

Here, a lowering speed determination method during automatic lowering operation will be described with reference to FIG. 6.

Figure 6:
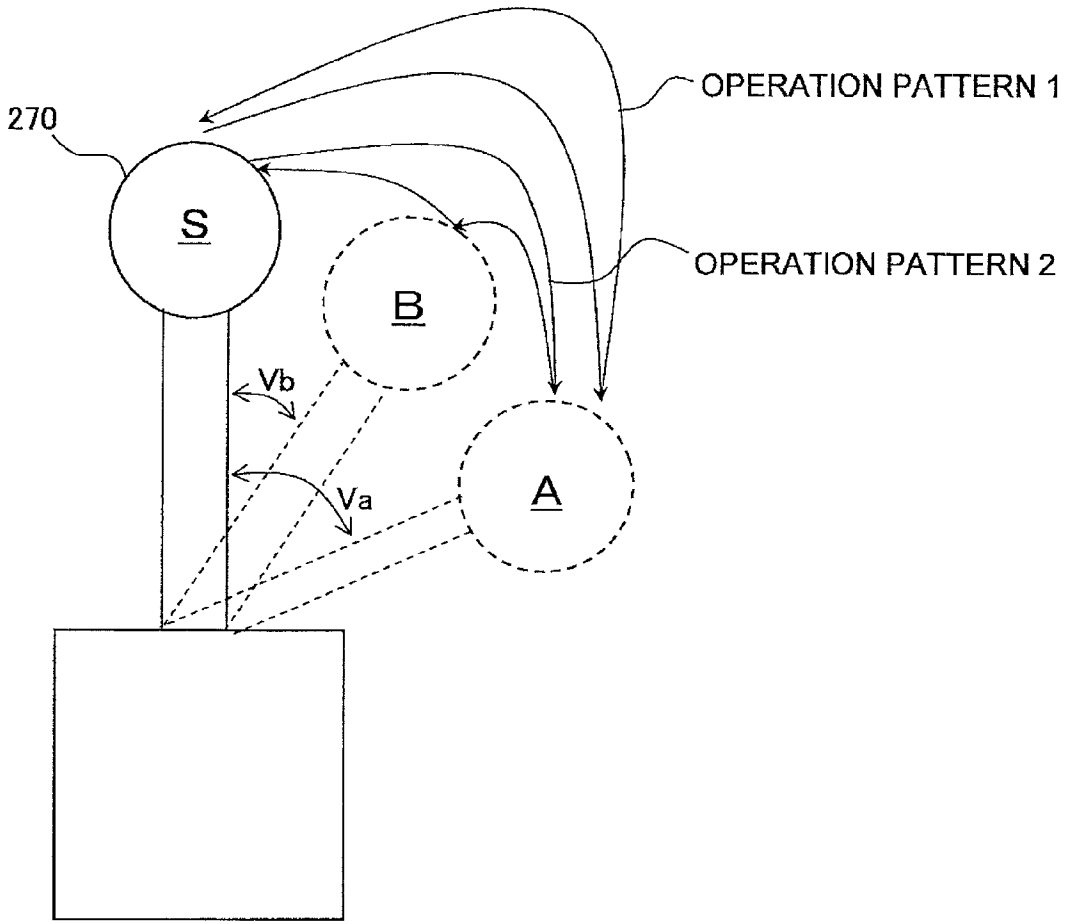
FIG. 6 is a diagram for describing a lowering speed determination method in an automatic lowering operation.

An operation pattern 1 which is shown in FIG. 6 is an operation where the blade operation lever 270 is initially operated from the holding position S where a holding instruction signal is output to a position A where a lowering instruction signal is output and the blade operation lever 270 is returned to the holding position S after being held at the position A for a first time period (for example, approximately 0.1 seconds). In this operation, when the operating amount from the holding position S to the position A is set as a first value Va, the operating amount V in the operation pattern 1 is quickly increased from "0" to the first value Va, is held at the first value Va for a first time period, and is quickly reduced from the first value Va to "0".

In this case, the blade control section 215 determines the lowering speed based on the first value Va. Here, it is sufficient if the first value Va is a value greater than "0", but the first value Va may be set to a value of equal to or more than a predetermined threshold (for example, 50% of the maximum operating amount from the holding position S to the maximum lowering position $D_{MAX}$) in a case where the blade operation lever 270 idles at the holding position S.

On the other hand, an operation pattern 2 is an operation where the blade operation lever 270 is initially operated from the holding position S to the position A, the blade operation lever 270 is returned to a position B where a lowering instruction signal is output after having been held for the first time period at the position A, and the blade operation lever 270 is returned to the holding position S after having been held for a second time period (for example, approximately 0.5 seconds) at the position B. Here, the position B is a position which is more to the front than the position A. In this operation, when the operating amount from the holding position S to the position B is set as a second value Vb, the operating amount V in the operation pattern 2 is quickly increased from "0" to the first value Va, is held at the first value Va for the first time period, is quickly reduced from the first value Va to the second value Vb, is held at the second value Vb for the second time period, and is quickly reduced from the second value Vb to "0".

In this case, the blade control section 215 determines the lowering speed based on the second value Vb. Here, it is sufficient if the second value Vb is a value which is greater than "0" and a value which is different to the first value Va, but the second value Vb may be set as a value which is equal to or more than the predetermined threshold described above.

Here, it is sufficient if the lowering speed in the automatic lowering operation is set so as to increase as the operating amount V increases. For example, it is sufficient if the blade control section 215 selects a speed according to the first value Va or the second value Vb from the plurality of speed levels (for example, high speed and low speed) as the lowering speed, and it is also sufficient if a speed which is directly proportional to the operating amount V is set as the lowering speed. In whatever manner the lowering speed is set, the lowering speed in the operation pattern 2 is slower than the lowering speed in the operation pattern 1 in a case where the second value Vb is smaller than the first value Va.

Automatic Lowering Operation of Blade 40

Figure 7:
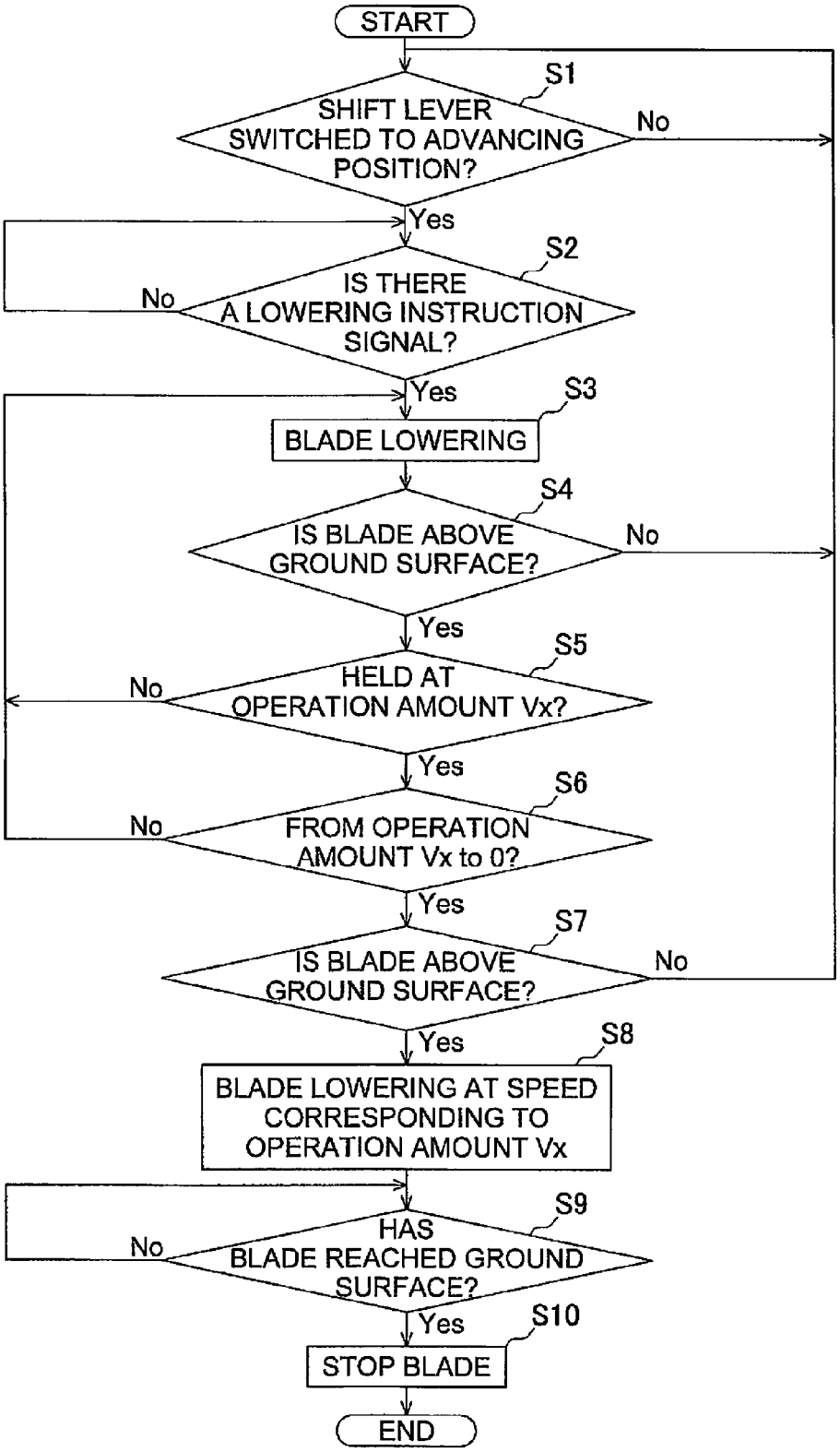
FIG. 7 is a flow chart for describing the automatic lowering operation of the blade.
Figure 8:
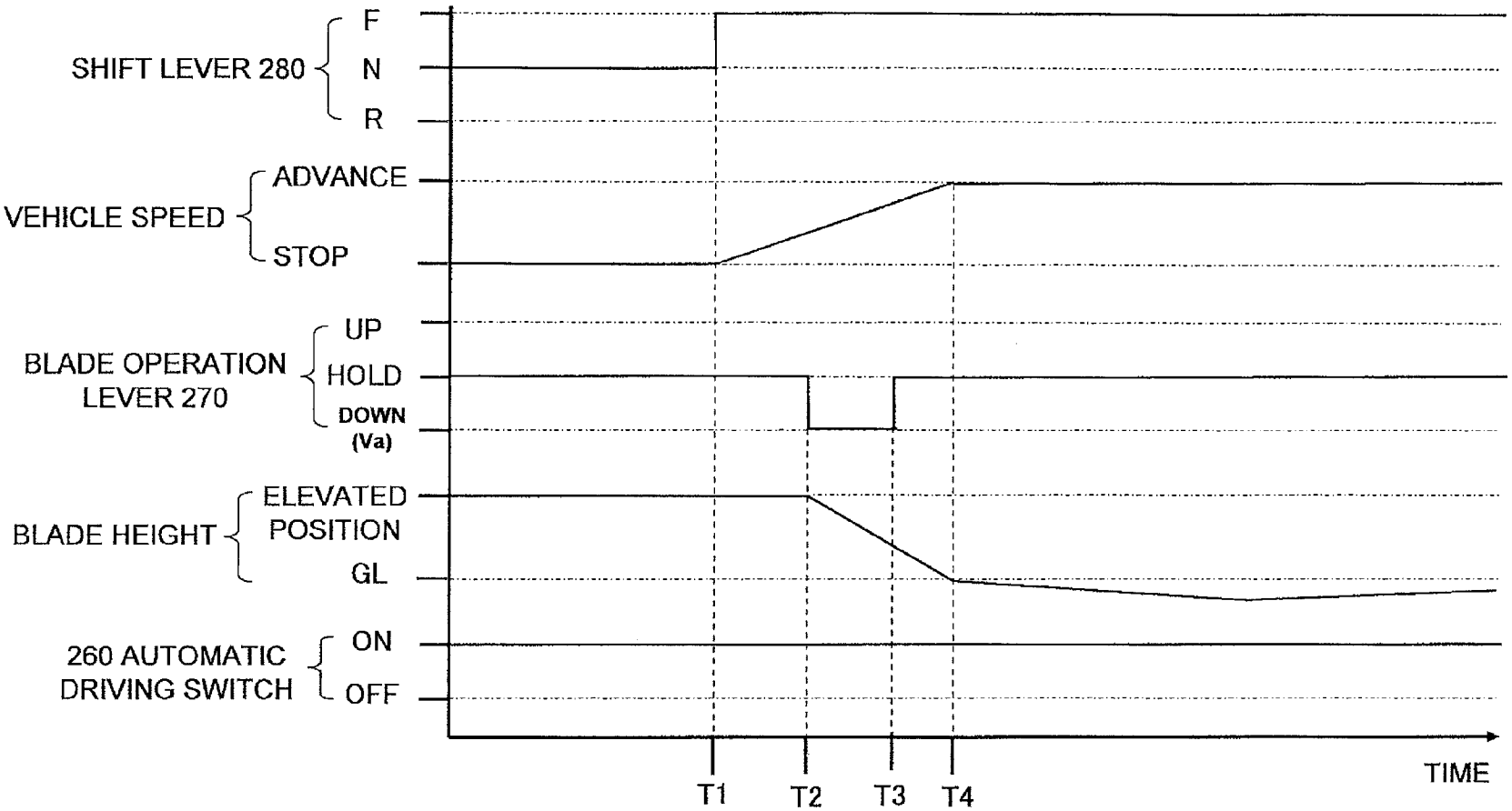
FIG. 8 is a time chart illustrating an operating state of the bulldozer.

FIG. 7 is a flow chart for describing the automatic lowering operation of the blade 40. FIG. 8 is a time chart illustrating an operating state of the bulldozer 100. The time chart of FIG. 8 corresponds with the movement of the operation lever 270 in the operation pattern 1 which is shown in FIG. 6. Here, in the following description, the automatic driving start instruction for the bulldozing work from the automatic driving switch 260 is set as an input as shown in FIG. 8.

In Step S1, the controller 210 determines whether or not the transmission 12*b* has switched from a state which is different to the advancing state (that is, the reversing state or the neutral state) to the advancing state. The process proceeds to Step S2 in a case where the transmission 12*b* has been switched to the advancing state. The process repeats Step S1 in a case where the transmission 12*b* has not been switched to the advancing state. In the example which is shown in FIG. 8, the transmission 12*b* is switched from the neutral state to the advancing state at a timing T1.

In Step S2, the controller 210 determines whether or not the lowering instruction signal for the blade 40 has been input. In Step S3, the bulldozer 100 lowers the blade 40 at a speed according to the operating amount V which is included in a lowering instruction signal in a case where a lowering instruction signal has been input. The process repeats Step S2 in a case where the lowering instruction signal has not been input. In the example which is shown in FIG. 8, a lowering instruction signal has been input at a timing T2 while the bulldozer 100 is advancing.

In Step S4, the controller 210 determines whether to not the blade 40 is above the ground surface GL. The process proceeds to Step S5 in a case where the blade 40 is above the ground surface GL. The process returns to Step S1 in a case where the blade 40 has reached the ground surface GL or is below the ground surface GL.

In Step S5, the controller 210 determines whether or not the operating amount V of the blade operation lever 270 has been held for a predetermined time or more at an arbitrary operating amount Vx which is output in the lowering instruction signal. A predetermined time in the embodiment is 0.1 seconds. It is possible to determine that an operation, where the blade operation lever 270 is immediately switched from an operation in the blade lowering direction to an operation in the holding position direction, has been held for the predetermined time or more at the operating amount Vx when the predetermined time is set at 0.1 seconds.

The process proceeds to Step S6 in a case of the operation of the blade operation lever 270 being held at the operating amount Vx for the predetermined time or more. The blade lowering operation in Step S3 is continued in a case of the operation of the blade operation lever 270 not being held at the operating amount Vx for the predetermined time or more. In the example which is shown in FIG. 8, the case is shown where the operating amount is held for the predetermined time or more at the first value Va from the timing T2 to a timing T3. Here, although not shown in FIG. 7, the process returns to Step S1 when the operating amount V of the blade operation lever 270 is set at an amount (a negative value) which is output in the raising instruction signal for the blade 40 at all points in time in the flow of Step S1 and beyond.

In Step S6, the controller 210 directly determines whether or not the operating amount V of the blade operation lever 270 is the operating amount "0" which is output in the holding instruction signal from the operating amount Vx which is output in the lowering instruction signal.

Taking the operation pattern 2 which is shown in FIG. 6 as an example, the process returns from Step S6 to Step S3 since the operating amount is set from Va to Vb which is not "0" when the blade operation lever 270 is held at the position A (operating amount=Va) and operated to be at the position B (operating amount=Vb). Then, the process proceeds from Step S6 to Step S7 since the operating amount V is set from Vb to "0" when the blade operation lever 270 is held at the position B and operated to be at the holding position S (operating amount="0").

In Step S7, the controller 210 determines again whether or not the blade 40 is positioned above the ground surface GL since the blade 40 continues lowering while the process proceeds from Step S4 to Step S7. The process returns to Step S1 when it is determined that the blade 40 has reached the ground surface GL or is positioned below the ground surface GL, and is not positioned above the ground surface GL. The process proceeds to Step S8 when it is determined that the blade 40 is positioned above the ground surface GL.

In Step S8, the controller 210 lowers the blade 40 at a lowering speed corresponding to the operating amount Vx (the operating amount Va in the operation pattern 1 or the operating amount Vb in the operation pattern 2) which is held for a predetermined time after the blade operation lever 270 has been set immediately before being set at the operating amount of "0".

Next, in Step S9, the lowering of the blade 40 is continued until it is determined that the blade 40 has reached the ground surface GL. In Step S9, the process next proceeds to Step S10 when it is determined that the blade 40 has reached the ground surface GL.

In Step S10, the bulldozer 100 stops the lowering of the blade 40. The automatic lowering operation of the blade 40 is completed, and the automatic lowering operation is repeated again from Step S1. Here, in the example which is shown in FIG. 8, the lowering of the blade 40 is started again from a timing T4 in order for the bulldozing work to be started at the same time as the automatic lowering operation of the blade 40 is completed.

Actions and Effects

The blade control section 215 lowers the blade 40 to the ground surface GL (one example of the predetermined position) when a lowering instruction signal and a holding instruction signal are input in order after the transmission 12*b* has been switched from a state which is different to the advancing state to the advancing state.

Accordingly, it is possible to suppress the execution of the automatic lowering operation of the blade 40 which is against the intention of the operator since the automatic lowering operation of the blade 40 is executed using a lowering instruction signal for the blade 40 from the operator as a trigger. Accordingly, it is possible to execute control of the blade 40 according to the intention of the operator.

(2) The blade control section 215 lowers the blade 40 at a lowering speed based on the operating amount of the blade operation lever 270 from the operator.

Accordingly it is possible to execute further control of the blade 40 according to the intention of the operator since the automatic lowering operation of the blade 40 is executed at a lowering speed which is desired by the operator.

(3) The blade control section 215 determines the lowering speed based on the second value Vb in a case where the operating amount of the blade operation lever 270 is held at the first value Va for the first time period and is returned to 0 after being held at the second value Vb which is smaller than the first value Va for the second time period.

Accordingly, it is possible for the automatic lowering operation to reflect precise operation of the blade operation lever 270 by the operator.

Other Embodiments

An embodiment of the present invention was described above but the present invention is not limited to the embodiment described above and various modifications are possible within a scope that does not deviate from the gist of the invention.

In the embodiment described above, the bulldozer 100 aligns the cutting edge 40P on the blade 40 with the ground surface GL in the automatic lowering operation of the blade 40, but the present invention is not limited to this. It is sufficient if the blade 40 is lowered to a predetermined position which is set in advance in the automatic lowering operation. For example, it is possible for a position which matches the designed surface, a position which is separated from the ground surface GL or the designed surface with a predetermined gap, or the like to be given as examples of the predetermined position.

(B) In the embodiment described above, the bulldozer 100 determines the lowering speed in the automatic lowering operation according to the operating amount, but the present invention is not limited to this. The lowering speed in the automatic lowering operation may be set to a value determined in advance.

(C) In the embodiment described above, the bulldozer 100 determines whether or not the operating amount is held at the first value Va or the second value Vb, but the present invention is not limited to this. The bulldozer 100 may determine only whether or not the operating amount is held at the first value Va or may further determine whether or not the operating amount is held at a third value Vc which is smaller than the second value Vb.

(D) In the embodiment described above, the bulldozer 100 calculates the distance between the designed surface and the cutting edge 40P in a direction which is perpendicular to the designed surface, but the present invention is not limited to this. The bulldozer 100 may calculate the distance in the direction which intersects with the perpendicular direction. In addition, the bulldozer 100 may calculate the distance between the designed surface and a portion other than the cutting edge 40P of the blade 40.

(E) Although not particularly mentioned in the embodiment described above, control may be executed so that the blade 40 is automatically raised to the predetermined position in a case where the bulldozing work is performed at the second point as shown in FIG. 5(*a*). In detail, the blade 40 is automatically raised to the predetermined position at a speed according to the operating amount V when a raising instruction signal and a holding instruction signal are output in order from the blade operation lever 270 in a case where the shift lever 280 is switched to the reversing position R. According to this control, it is possible to suppress the execution of the automatic raising operation of the blade 40 which is against the intention of the operator since the automatic raising operation of the blade 40 is executed with the raising instruction signal as a trigger due to an operation by the operator. Accordingly, it is possible to execute control of the blade 40 according to the intention of the operator.

INDUSTRIAL APPLICABILITY

According to the present invention, it is possible to provide a bulldozer and a blade control method where it is possible to execute blade control according to the intention of an operator and which is useful in the field of operating work machinery.

What is claimed is:

1. A bulldozer comprising:

a blade pivotably attached to a vehicle body;

a blade operation lever configured to output a lowering instruction signal, a holding instruction signal, and a raising instruction signal for the blade; and a blade control section configured to control a height of the blade according to the lowering instruction signal or the raising instruction signal when the lowering instruction signal or the raising instruction signal is input, the blade control section being further configured to execute an automatic lowering control of the blade to a predetermined position after a transmission has been switched from a state, which is different from an advancing state, to the advancing state, the blade control section withholding the execution of the automatic lowering control until the transmission has been switched to the advancing state and, thereafter, the lowering instruction signal and the holding instruction signal have been input in order.

2. The bulldozer according to claim 1, wherein the blade control section is further configured to execute the automatic lowering control of the blade to the predetermined position at a lowering speed, the lowering speed being variably set based on an operating amount of the blade operation lever, the operating amount being included in the lowering instruction signal which was input after the transmission was switched to the advancing state.

3. The bulldozer according to claim 2, wherein the blade control section is further configured to use an operating amount of the blade operation lever that was held for a predetermined time period immediately before the holding instruction signal was input as the prescribed operating amount of the blade operation lever.

4. The bulldozer according to claim 2, wherein the blade control section is further configured to use a second operating amount of the blade operation lever as the prescribed operating amount when the blade operation lever is held at a first operating amount for a first time period and subsequently held at the second operating amount for a second time period, the second operating amount being smaller than the first operating amount.

5. A bulldozer comprising:

a blade pivotably attached to a vehicle body;

a blade operation lever configured to output a lowering instruction signal, a holding instruction signal, and a raising instruction signal for the blade; and a blade control section configured to control a height of the blade according to a signal which has been input when either the lowering instruction signal or the raising instruction signal is input, the blade control section being further configured to execute an automatic raising control of the blade to a predetermined position after a transmission has been switched from a state, which is different from a reversing state, to the reversing state, the blade control section withholding the execution of the automatic raising control until the transmission has been switched to the reversing state and, thereafter, the raising instruction signal and the holding instruction signal have been input in order.

6. A blade control method in a bulldozer, which has a blade pivotably attached to a vehicle body and a blade operation lever configured to output a lowering instruction signal, a holding instruction signal, and a raising instruction signal for the blade, the method comprising:

determining if a transmission of the bulldozer has been switched from a state, which is different to an advancing state, to the advancing state;

determining if the blade operation lever has outputted the lowering instruction signal and the holding instruction signal in order; and starting an automatic lowering control to lower the blade of the bulldozer to a predetermined position above a designed surface, which is three dimensional designated terrain indicating a desired shape of a digging target, upon determining that the lowering instruction signal and the holding instruction signal having been outputted in order after having determined that the transmission was switched to the advancing state.

* * * * *